US012104604B2

(12) United States Patent
Yamazaki

(10) Patent No.: US 12,104,604 B2
(45) Date of Patent: Oct. 1, 2024

(54) AXIAL FAN

(71) Applicant: SANYO DENKI CO., LTD., Tokyo (JP)

(72) Inventor: Yoshihisa Yamazaki, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 0 days.

(21) Appl. No.: 18/476,412

(22) Filed: Sep. 28, 2023

(65) Prior Publication Data

US 2024/0110572 A1 Apr. 4, 2024

(30) Foreign Application Priority Data

Sep. 30, 2022 (JP) ..... 2022-157842

(51) Int. Cl.
*F04D 19/00* (2006.01)
*F04D 29/38* (2006.01)

(52) U.S. Cl.
CPC ..... *F04D 19/002* (2013.01); *F04D 29/384* (2013.01)

(58) Field of Classification Search
CPC .... F04D 19/002; F04D 29/384; F04D 29/386; F05D 2240/301–307
See application file for complete search history.

(56) References Cited

U.S. PATENT DOCUMENTS

| | | | | |
|---|---|---|---|---|
| 5,616,004 | A * | 4/1997 | Alizadeh | F04D 29/384 416/169 A |
| 6,994,523 | B2 * | 2/2006 | Eguchi | F04D 29/384 416/235 |
| 10,047,764 | B2 * | 8/2018 | Tadokoro | F04D 29/545 |
| 10,662,973 | B2 * | 5/2020 | Yamazaki | F04D 29/384 |
| 11,933,315 | B2 * | 3/2024 | Yamazaki | F04D 29/325 |
| 2008/0253897 | A1 * | 10/2008 | Yamamoto | F04D 29/666 416/223 R |
| 2023/0417249 | A1 * | 12/2023 | Ishibashi | F04D 19/002 |

FOREIGN PATENT DOCUMENTS

JP 3089140 U 10/2002

OTHER PUBLICATIONS

JP2000192898A (Year: 2000).*
JP2022112049A (Year: 2022).*

* cited by examiner

*Primary Examiner* — Brian P Wolcott
(74) *Attorney, Agent, or Firm* — RANKIN, HILL & CLARK LLP

(57) ABSTRACT

Provided is an axial fan including a plurality of blades configured to produce an air current flowing from an inlet side to an outlet side, in which: the blade includes a curved portion rising toward the inlet side along an outer peripheral edge of the blade; a starting position of the curved portion delineates a convex curve protruding radially outward on the blade as viewed from the inlet side; and letting a total length of the convex curve be X, a length Y from an end of the convex curve on a front edge of the blade to a vertex of the convex curve satisfies a relationship of $0<Y\leq 0.6X$ as viewed from the inlet side.

3 Claims, 11 Drawing Sheets

AXIAL FAN

CROSS-REFERENCE TO RELATED APPLICATION

This application is based on Japanese Patent Application No. 2022-157842 filed with the Japan Patent Office on Sep. 30, 2022, the entire content of which is hereby incorporated by reference.

BACKGROUND

1. Technical Field

The present disclosure relates to an axial fan.

2. Related Art

Japanese Utility Model No. 3089140 discloses an axial fan provided with a protruding edge along the outer edge of a blade.

According to the axial fan of Japanese Utility Model No. 3089140, a curved portion provided along the outer peripheral edge of the blade can inhibit air from flowing outward of the outer peripheral edge due to the centrifugal force caused during the rotation of an impeller. Hence, the air flows along the outer peripheral edge. In this manner, the performance of the fan such as airflow rate-static pressure characteristics increases.

However, when the number of rotations or static pressure of the impeller increases, the air flows over the curved portion and then outward of the outer peripheral edge. Hence, the performance of the fan may decrease.

Moreover, it is conceivable that the curve angle of the curved portion is increased to inhibit the air from flowing over the curved portion and then outward of the outer peripheral edge. However, if the curve angle of the curved portion is increased, although the air is inhibited from flowing outward of the outer peripheral edge, the airflow rate decreases, which may lead to a decrease in fan performance instead.

Hence, an object of the present disclosure is to provide an axial fan having high fan performance.

SUMMARY

An axial fan according to an embodiment of the present disclosure includes a plurality of blades configured to produce an air current flowing from an inlet side to an outlet side, in which: the blade includes a curved portion rising toward the inlet side along an outer peripheral edge of the blade; a starting position of the curved portion delineates a convex curve protruding radially outward on the blade as viewed from the inlet side; and letting a total length of the convex curve be X, a length Y from an end of the convex curve on a front edge of the blade to a vertex of the convex curve satisfies a relationship of $0<Y\leq 0.6X$ as viewed from the inlet side.

DETAILED DESCRIPTION

Figure 1B:
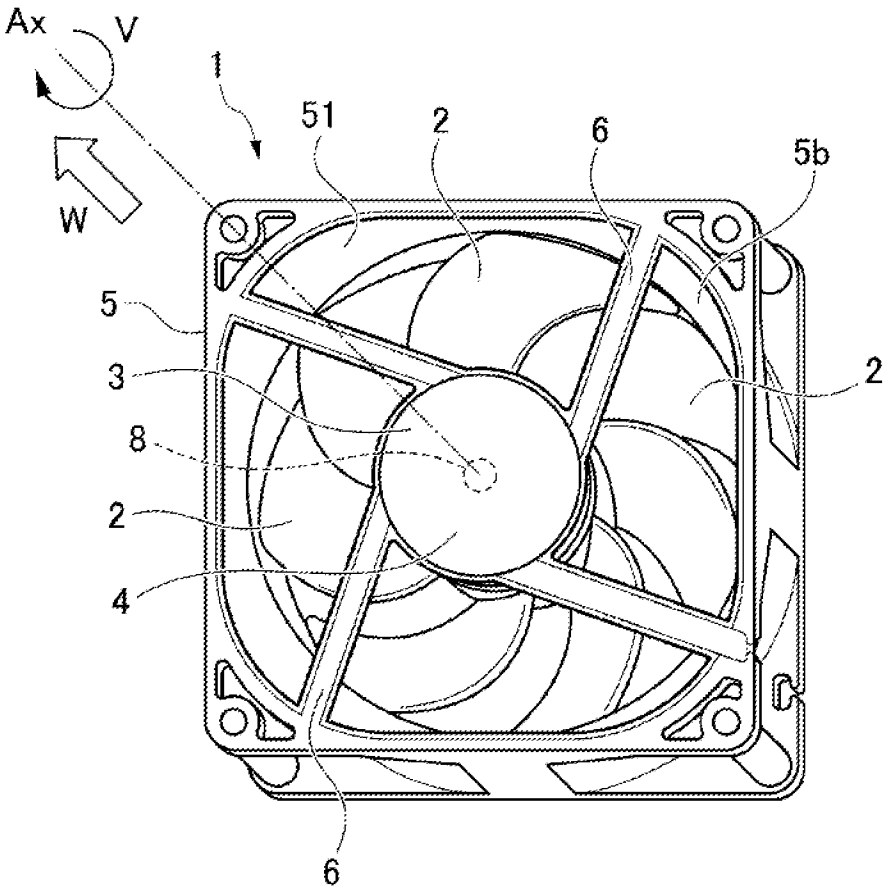
FIGS. 1A and 1B are perspective views of an axial fan according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

An axial fan according to one aspect of the present disclosure includes a plurality of blades configured to produce an air current flowing from an inlet side to an outlet side, in which: the blade includes a curved portion rising toward the inlet side along an outer peripheral edge of the blade; a starting position of the curved portion delineates a convex curve protruding radially outward on the blade as viewed from the inlet side; and letting a total length of the convex curve be X, a length Y from an end of the convex curve on a front edge of the blade to a vertex of the convex curve satisfies a relationship of $0<Y\leq 0.6X$ as viewed from the inlet side.

According to the present disclosure, it is possible to provide an axial fan having high fan performance.

An embodiment of the present disclosure is described hereinafter with reference to the drawings. Note that descriptions of members having the same reference numerals as members that have already been described are omitted in the detailed description for the convenience of description. Moreover, the dimensions of each member illustrated in the drawings may be different from actual dimensions thereof for the convenience of description.

Figure 1A:
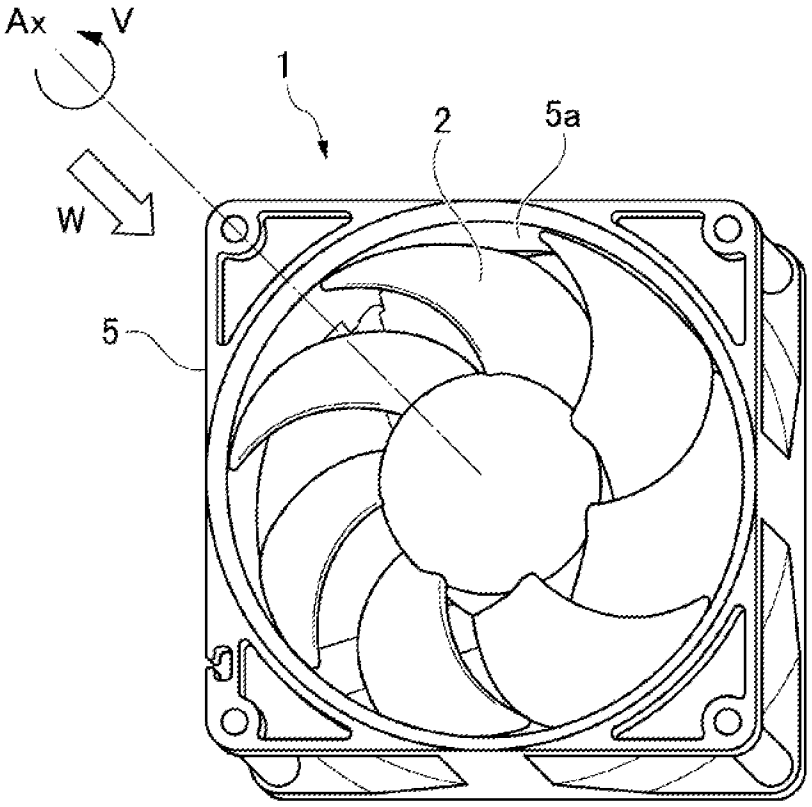

FIG. 1 is perspective views of an example of an axial fan 1 according to the embodiment of the present disclosure. FIG. 1A is a perspective view of the axial fan 1 as viewed from an inlet side (hereinafter referred to as the upstream side). FIG. 1B is a perspective view of the axial fan as viewed from an outlet side (hereinafter referred to as the downstream side).

As illustrated in FIGS. 1A and 1B, the axial fan 1 includes an impeller 3 having a plurality of blades 2, a motor 4 provided in the impeller 3, a housing 5 that accommodates the impeller 3 and the motor 4, and a spoke 6 that connects the impeller 3 and the housing 5.

The motor 4 drives and rotates the impeller 3 in a rotation direction V about a rotation axis Ax of a rotary shaft 8.

The entire housing 5 is formed in, for example, an approximately rectangular shape. The housing 5 includes an inlet 5*a* through which air is drawn in, and an outlet 5*b* through which the air that has been drawn in is discharged. The rotation of the plurality of blades 2 allows the air to be drawn in through the inlet 5*a*, sent in an air-blowing direction W, and discharged to the outside through the outlet 5*b*. Put another way, the axial fan 1 produces an air current that flows from the inlet 5*a* to the outlet 5*b*.

The housing 5 includes an inner peripheral wall 51 that delimits a circular cylindrical space that accommodates the impeller 3. The inner diameter of the inner peripheral wall 51 is slightly greater than the outer diameter of the impeller 3.

Figure 2:
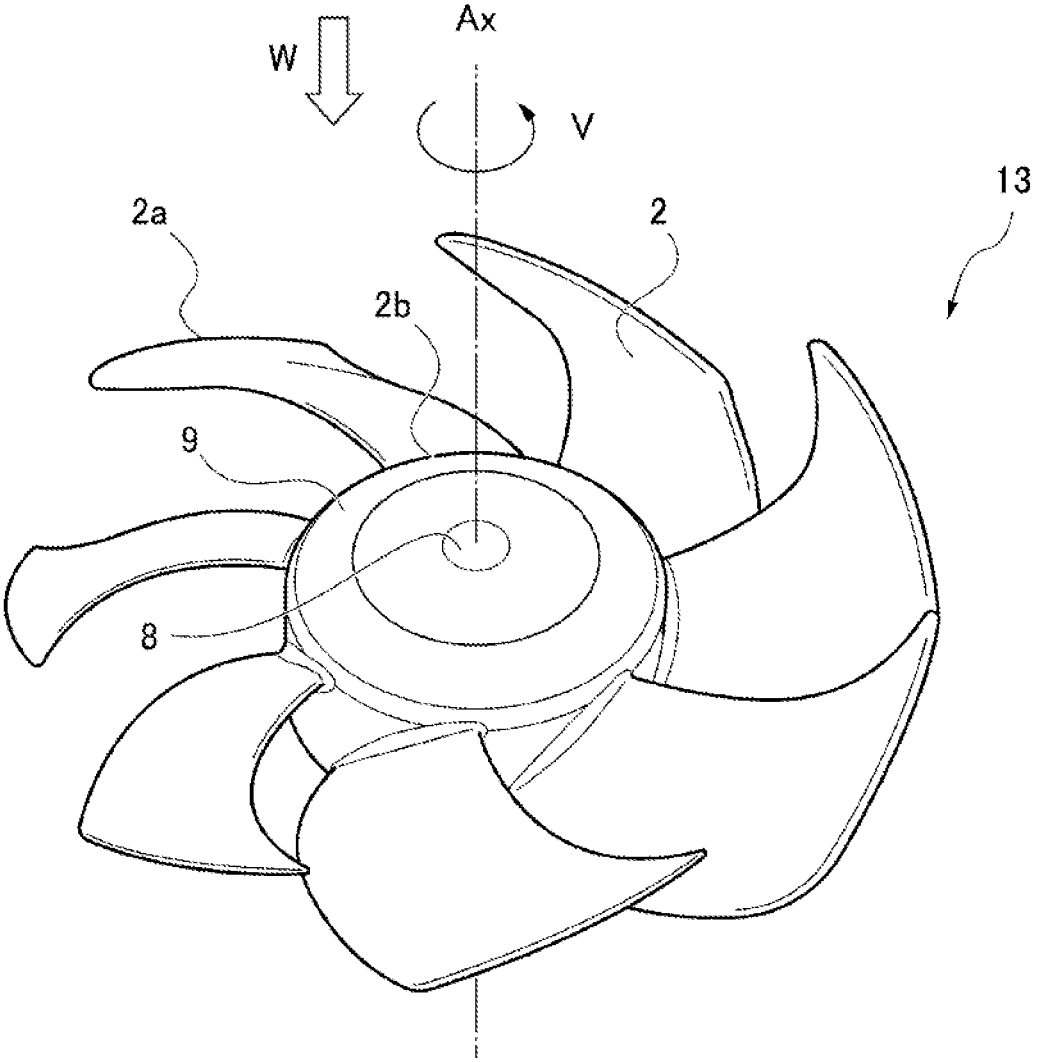
FIG. 2 is a perspective view of an impeller of the axial fan according to the embodiment of the present disclosure.

FIG. 2 is a perspective view of the impeller 3 of the axial fan 1 according to the embodiment of the present disclosure. In an example illustrated in FIG. 2, the impeller 3 includes a cup-shaped hub 9, and the plurality of blades 2 that extend radially outward from the hub 9. The plurality of blades 2 is attached to a peripheral wall portion of the hub 9. The plurality of blades 2 is forward swept blades in each of which a front end of an outer peripheral edge 2*a* of the blade 2 is ahead of a front end of a root 2*b* of the blade 2 in the rotation direction V. Moreover, each of the plurality of blades 2 is provided in such a manner as to be inclined relative to an axial direction of the rotary shaft 8.

Note that in the following description, when a front-and-back direction is referred to, the direction is defined relative to the rotation direction V. In other words, a side in a travel direction of the rotation direction is referred to as forward, and a side in a direction opposite to the travel direction of the rotation direction is referred to as backward. In terms of outer edges of each of the blades 2, an edge located forward may be referred to as a front edge 2*c*, an edge located radially outward may be referred to as an outer peripheral edge 2*a*, and an edge located backward may be referred to as a back edge 2*d* (refer to FIG. 3).

Figure 3:
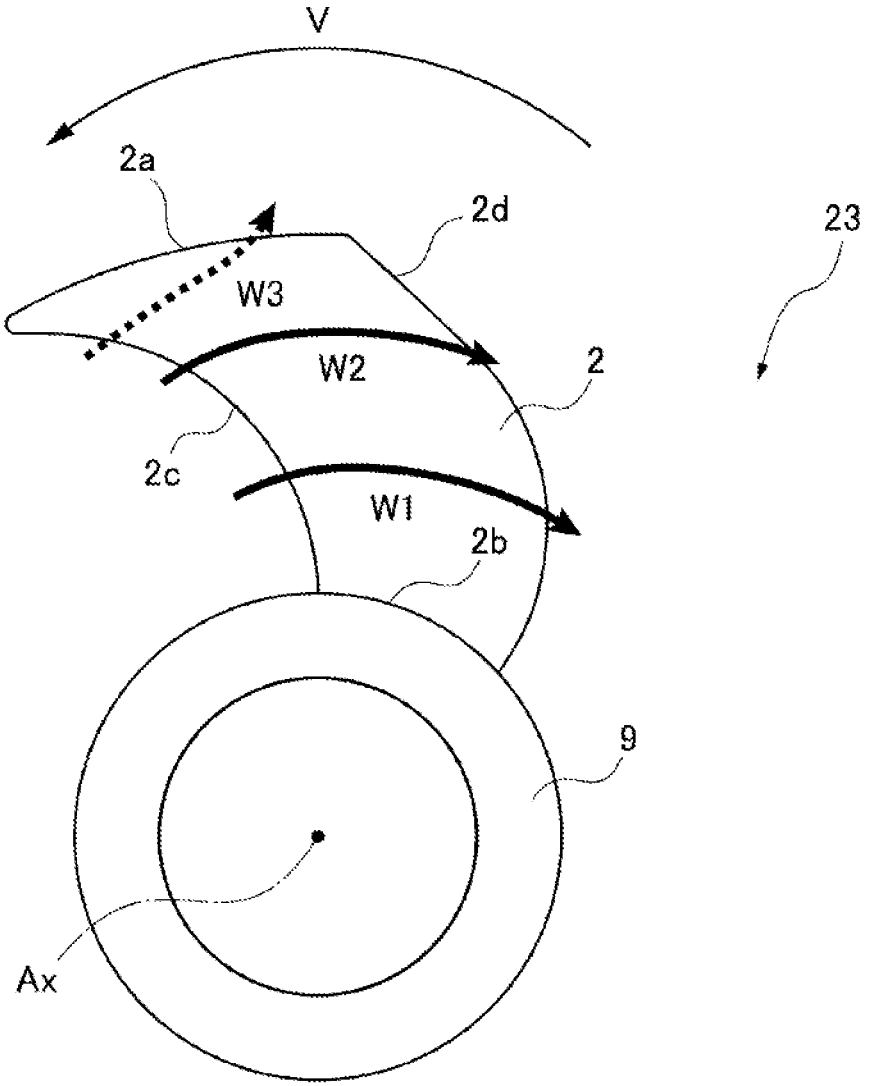
FIG. 3 is a plan view illustrating a part of a general impeller.

FIG. 3 is a plan view illustrating a part of a general impeller 23 as viewed from the upstream side. FIG. 3 illustrates only one of the plurality of blades 2 to facilitate understanding. Moreover, air currents W1 to W3 that flow over the surface of the blade 2 are represented by arrows to describe the flow of air over the surface of the blade 2. The air current W1 represents an air current that flows radially inward (closer to the root 2*b*) on the blade 2. The air current W2 represents an air current that flows in a radially middle area (a middle area between the root 2*b* and the outer peripheral edge 2*a*) on the blade 2. The air current W3 represents an air current that flows radially outward (closer to the outer peripheral edge 2*a*) on the blade 2.

As illustrated in FIG. 3, the general impeller 23 is not provided with a curved portion that rises from the upstream side (a side in a direction into the page of FIG. 3) toward the downstream side (a side in a direction out of the page of FIG. 3) along the outer peripheral edge 2*a* of the blade 2. Hence, when the impeller 23 rotates in the rotation direction V to produce an air current, then the centrifugal force acts on the air current W3 that flows radially outward. As a result, the air current W3 that flows as-is along the surface of the blade 2 keeps flowing radially outward and then out from the outer peripheral edge 2*a*. In this manner, when the air current W3 that flows out from the outer peripheral edge 2*a* is produced, the primary fan performance cannot be exhibited. Hence, the fan performance may decrease.

Figure 7:
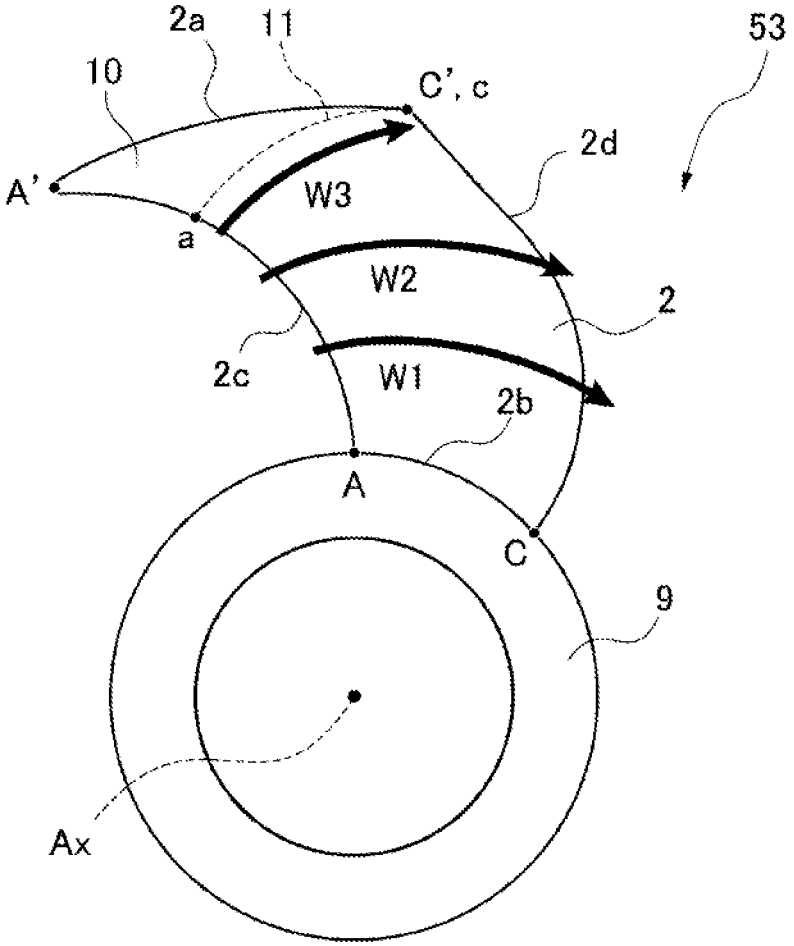
FIG. 7 is a plan view illustrating a part of an impeller according to Comparative Example 3.
Figure 8:
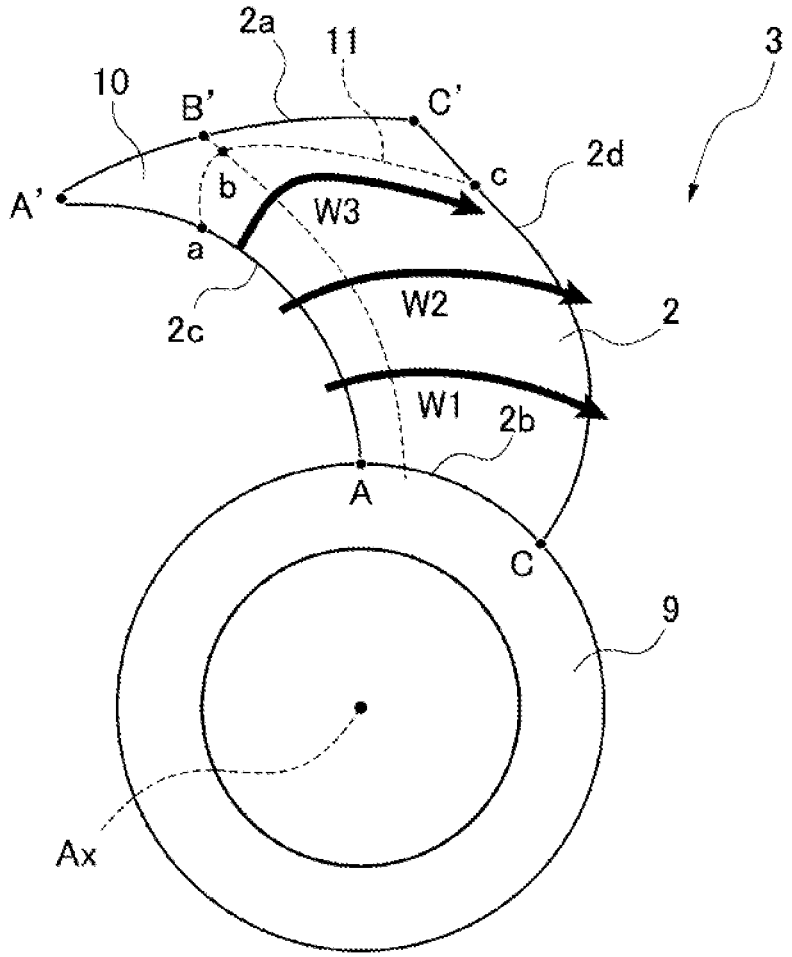
FIG. 8 is a plan view illustrating a part of an impeller according to the embodiment of the present disclosure.

In the present disclosure, FIG. 8 is used to describe the shape of the impeller 3 according to the embodiment of the present disclosure. Before the description, Comparative Examples 1 to 3 are described below with reference to FIGS. 4 to 6. Note that FIGS. 4 to 7 illustrate only one of the plurality of blades 2 to facilitate understanding.

Figure 4:
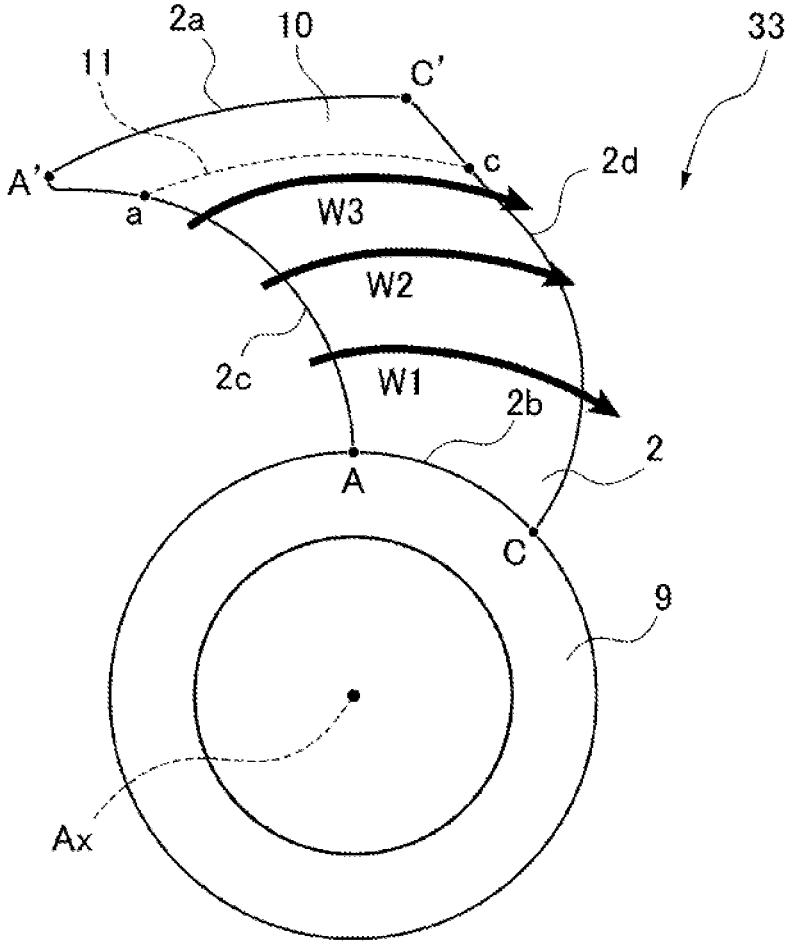
FIG. 4 is a plan view illustrating a part of an impeller according to Comparative Example 1.

FIG. 4 is a plan view illustrating a part of an impeller 33 according to Comparative Example 1. A curved portion 10 that rises from the upstream side (a side in a direction into the page of FIG. 4) toward the downstream side (a side in a direction out of the page of FIG. 4) is provided along the outer peripheral edge 2*a* of the blade 2 of the impeller 33 of Comparative Example 1 illustrated in FIG. 4.

In FIG. 4, an end at the root 2*b* on the front edge 2*c* of the blade 2 is defined as point A. An end at the outer peripheral edge 2*a* on the front edge 2*c* is defined as point A'. An end at the root 2*b* on the back edge 2*d* is defined as a point C. An end at the outer peripheral edge 2*a* on the back edge 2*d* is defined as a point C'.

Figure 5:
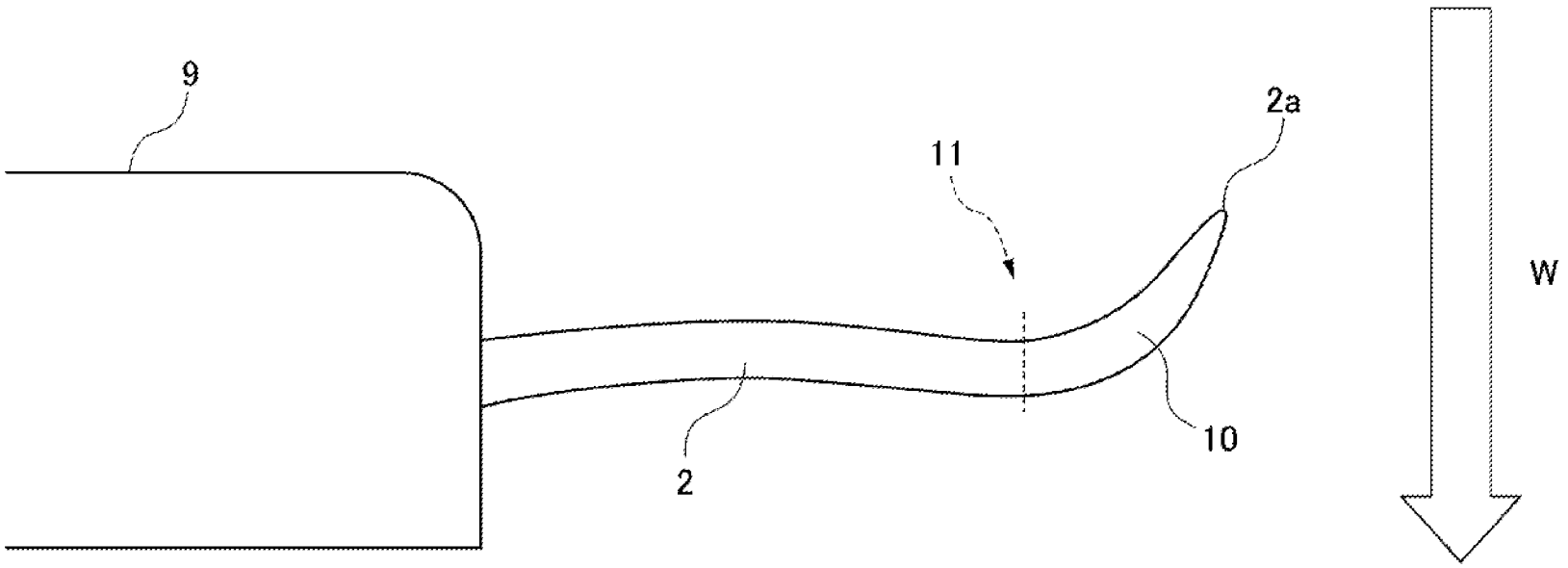
FIG. 5 is a cross-sectional view of a part of the impeller illustrated in FIG. 4.

FIG. 5 is a cross-sectional view of the impeller 33 illustrated in FIG. 4. As illustrated in FIG. 5, the surface of the blade 2 on the upstream side is formed as a curved surface that extends radially outward from the root 2*b*. The curvature of the curved surface that extends from the root 2*b* of the blade 2 changes on the outer peripheral side of the blade 2. In other words, the curved portion 10 that rises toward the upstream side is provided on the outer peripheral side of the blade 2. A point where the curvature of the curved surface that extends from the root 2*b* of the blade 2 starts changing on the surface on the upstream side of the blade 2 is referred to as a starting position 11 of the curved portion 10.

Return to FIG. 4. The starting position 11 of the curved portion 10 at an end on the front edge 2*c* is defined as point a. The starting position 11 of the curved portion 10 at an end on the back edge 2*d* is defined as point c. The starting position 11 of the curved portion 10 is indicated by a broken line from point a to point c.

As illustrated in FIG. 4, the curved portion 10 is provided from the front edge 2*c* to the back edge 2*d* of the blade 2. The starting position 11 (the broken line from point a to point c) of the curved portion 10 has an approximately arc shape along the outer peripheral edge 2*a*.

Figure 6:
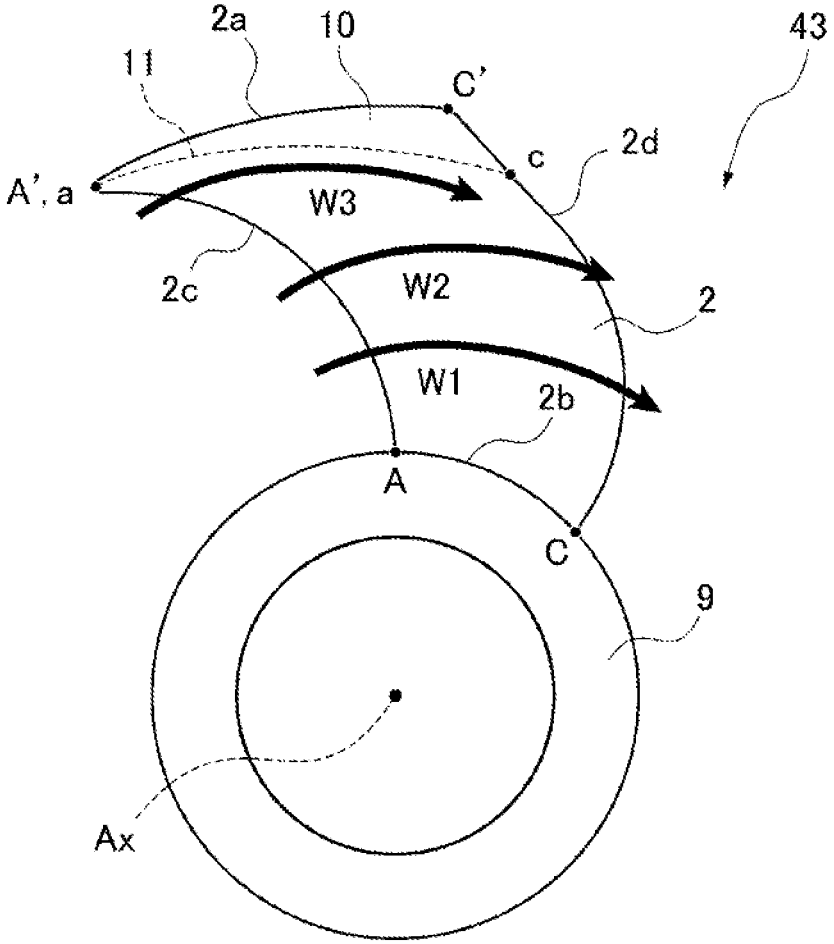
FIG. 6 is a plan view illustrating a part of an impeller according to Comparative Example 2.

FIG. 6 is a plan view illustrating a part of an impeller 43 according to Comparative Example 2. Note that points A, A', C, C', a, and c are defined as in FIG. 4. Moreover, the starting position 11 of the curved portion 10 is indicated by a broken line from point a to point c.

As illustrated in FIG. 6, in Comparative Example 2, point a coincides with point A'. In other words, the front edge 2*c* is not provided with the curved portion 10.

FIG. 7 is a plan view illustrating a part of an impeller 53 according to Comparative Example 3. Note that points A, A', C, C', a, and c are defined as in FIG. 4. Moreover, the starting position 11 of the curved portion 10 is indicated by a broken line from point a to point c.

As illustrated in FIG. 7, in Comparative Example 3, point c coincides with point C'. In other words, the back edge 2*d* is not provided with the curved portion 10.

The shape of the impeller 3 according to the embodiment of the present disclosure is described below with reference to FIG. 8.

FIG. 8 is a plan view illustrating a part of the impeller 3 according to the embodiment of the present disclosure. Note that points A, A', C, C', a, and c are defined as in FIG. 4. Moreover, the starting position 11 of the curved portion 10 is indicated by a broken line from point a to point c.

As illustrated in FIG. 8, the starting position 11 of the curved portion 10 of the impeller 3 of the embodiment delineates a convex curve that protrudes radially outward. The vertex of the convex curve is defined as point b. A point where a virtual line extending radially outward through point b along the shape of the blade 2 intersects with the outer peripheral edge 2*a* is defined as point B'.

Point b is set in such a manner that the length of a curve from point A' to point a is greater than the length of a curve from point B' to point b and that the length of the curve from point B' to point b is less than the length of a curve from point C' to point c.

As described in FIG. 3, in the axial fan that is not provided with the curved portion 10, the air current W3 flows out from the outer peripheral edge 2*a*. Hence, in FIG. 4, the curved portion 10 is provided which includes the starting position 11 that stretches along the outer peripheral edge 2*a*. However, simply providing such a curved portion 10 results in the air current W3 flowing over the curved portion 10 and then out from the outer peripheral edge 2*a* under, for example, an environment where a high static pressure acts due to the rotation of the motor at a high number of rotations. Hence, it was studied that the shape of the starting position 11 of the curved portion 10 was devised to inhibit the air current W3 from flowing out from the outer peripheral edge 2*a*.

Firstly, providing the curved portion 10 of such a shape as that of FIG. 6 was studied. In terms of the shape of FIG. 4, the air current W3 tends to flow out at the back (near the back edge 2*d*) of the blade 2. Hence, it was considered that the air current W3 could be inhibited from flowing out from the outer peripheral edge 2*a* while the curved portion 10 is secured in a minimum size when the curved portion 10 is provided at the back of the blade 2 as illustrated in FIG. 6. However, the blade 2 illustrated in FIG. 6 allows the air current W3 that strikes the blade 2 to flow as-is radially outward and then out from the outer peripheral edge 2*a*. Therefore, the blade 2 cannot catch air efficiently. Hence, it was found that it is difficult for the curved portion 10 of such a shape as that of FIG. 6 to increase the performance of the axial fan.

Next, providing the curved portion 10 of such a shape as that of FIG. 7 was studied. The curved portion 10 is provided at the front (near the front edge 2*c*) of the blade 2 as illustrated in FIG. 7, which makes it difficult for the air current W3 that strikes the blade 2 to flow out from the front part of the outer peripheral edge 2*a*. Therefore, it seems that a certain ideal flow can be realized. However, the curved portion 10 has a different shape from the original shape of the blade 2. Hence, when the greatly curved portion 10 is secured, an original workload of the blade 2 decreases accordingly. As a result, the workload of the entire blade 2 decreases. Therefore, it was found that an airflow rate that can be produced by the axial fan decreases.

Hence, providing the curved portion 10 of a shape that is difficult for the air current W3 to flow out from the outer peripheral edge 2*a* and reduces the workload of the blade 2 as little as possible, as in FIG. 8, was studied.

In terms of the blade 2 having the curved portion 10 illustrated in FIG. 8, firstly, the greatly curved portion 10 was secured at the front edge 2*c* of the blade 2, which was close to the air inlet. In other words, a long distance from point A' to point a was set. In this manner, the greatly curved portion 10 provides the air current W3 with a vector that strongly flows backward, at the front edge 2*c* of the blade 2.

The size of the curved portion 10 is reduced in a middle portion of the blade 2 in a circumferential direction thereof. Hence, the air current W3 that flows onto the middle portion flows backward, maintaining the same momentum.

The vector of the air current W3 that flows past the middle portion, the vector being directed radially outward, increases gradually in strength due to the centrifugal force. Hence, the size of the curved portion 10 is gradually increased from the middle portion toward the back edge 2*d*. Consequently, the air current W3 is inhibited from flowing radially outward from the outer peripheral edge 2*a*.

The curved portion 10 of such a shape is provided. Therefore, it is possible to inhibit the air current W3 from flowing out from the outer peripheral edge 2*a* while minimizing the area of the curved portion 10.

Note that the starting position 11 of the curved portion 10 on the front edge 2*c* of the blade 2 (the end on the front edge 2*c* of the convex curve) may be located radially inward of the starting position 11 of the curved portion 10 on the back edge 2*d* of the blade 2 (the end on the back edge 2*d* of the convex curve). Consequently, the air current W3 can be provided with a stronger vector that flows backward, at the front edge 2*c* of the blade 2 closer to the air inlet.

Next, a description is given of measurement results of the static pressure-airflow rate characteristics (hereinafter referred to as the PQ characteristics) of axial fans using the general impeller 23, the impellers 33, 43, and 53 of Comparative Examples 1 to 3, and the impeller 3 of the embodiment.

Figure 9:
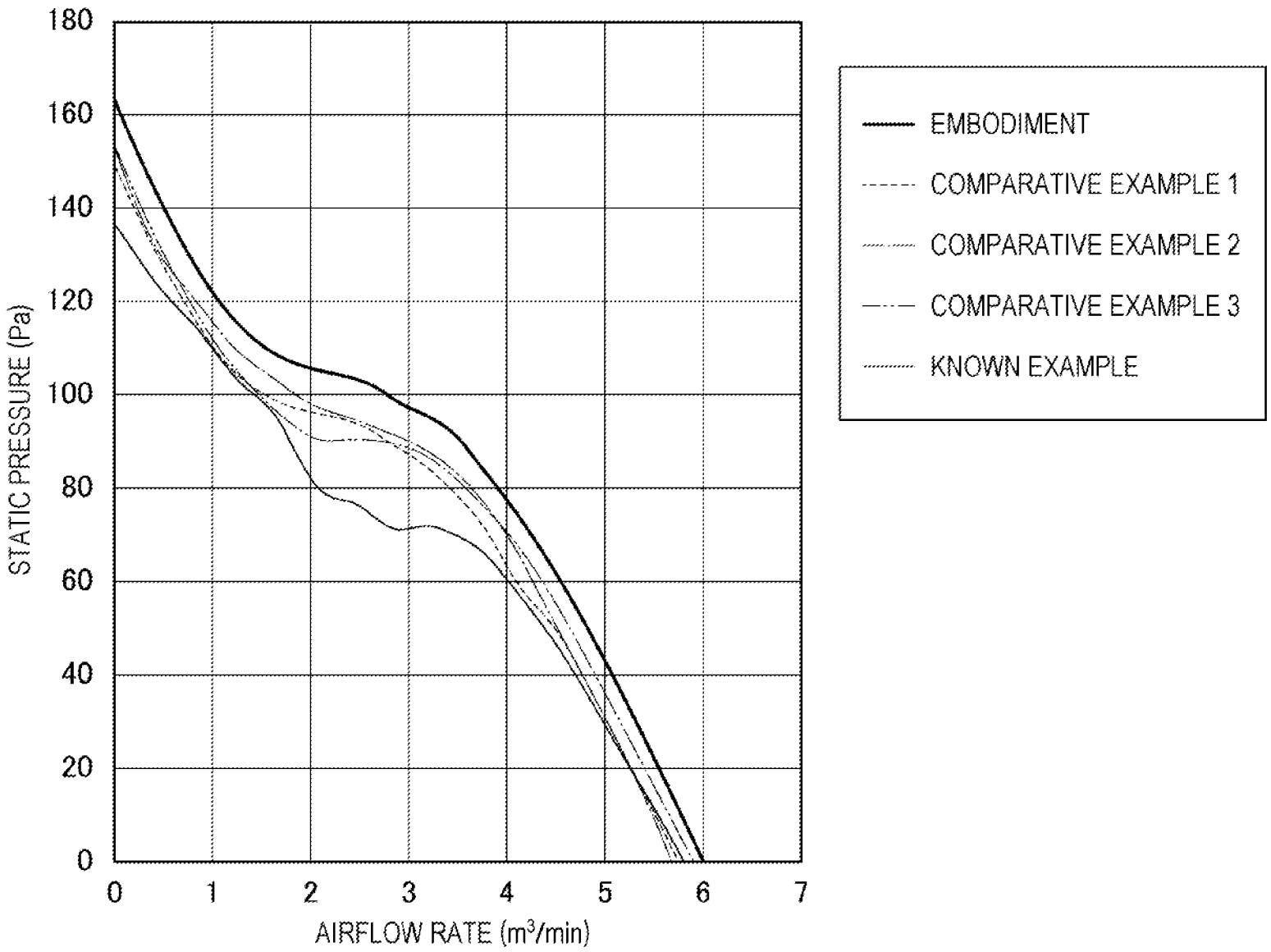
FIG. 9 is a graph illustrating static pressure-airflow rate characteristics (PQ characteristics) of the axial fan.

FIG. 9 is a graph illustrating the PQ characteristics of the axial fans using the impellers. The horizontal axis indicates the airflow rate, and the vertical axis indicates the static pressure. The airflow rate and static pressure of the axial fan that was driven with a predetermined amount of electric power were measured in the general impeller 23, the impellers 33, 43, and 53 of Comparative Examples 1 to 3, and the impeller 3 of the embodiment of the present disclosure.

As illustrated in FIG. 9, the static pressure at the time of driving the axial fan in such a manner as to output a specific airflow rate (for example, 3 $m^3$/min) increases sequentially from the axial fan using the general impeller 23 (approximately 70 pa), the axial fans using the impellers 33, 43, and 53 of Comparative Examples 1 to 3 (approximately 90 pa), and the axial fan using the impeller 3 of the embodiment (equal to or greater than 95 pa). Although the axial fans were turned on with the same amount of electric power, the axial fan according to the embodiment demonstrated the highest static pressure. Hence, it could be confirmed that the axial fan according to the embodiment was most efficient.

Next, the influence of the position of point b on power consumption in the axial fan including the impeller of the embodiment illustrated in FIG. 8 is described with reference to FIG. 10. Note than a relative position r of point b on the convex curve of the starting position 11 of the curved portion 10 is defined by the ratio of a length Y of the convex curve from point a to point b to a total length X of the convex curve (r=Y/X). r changes between 0 and 1.

Figure 10:
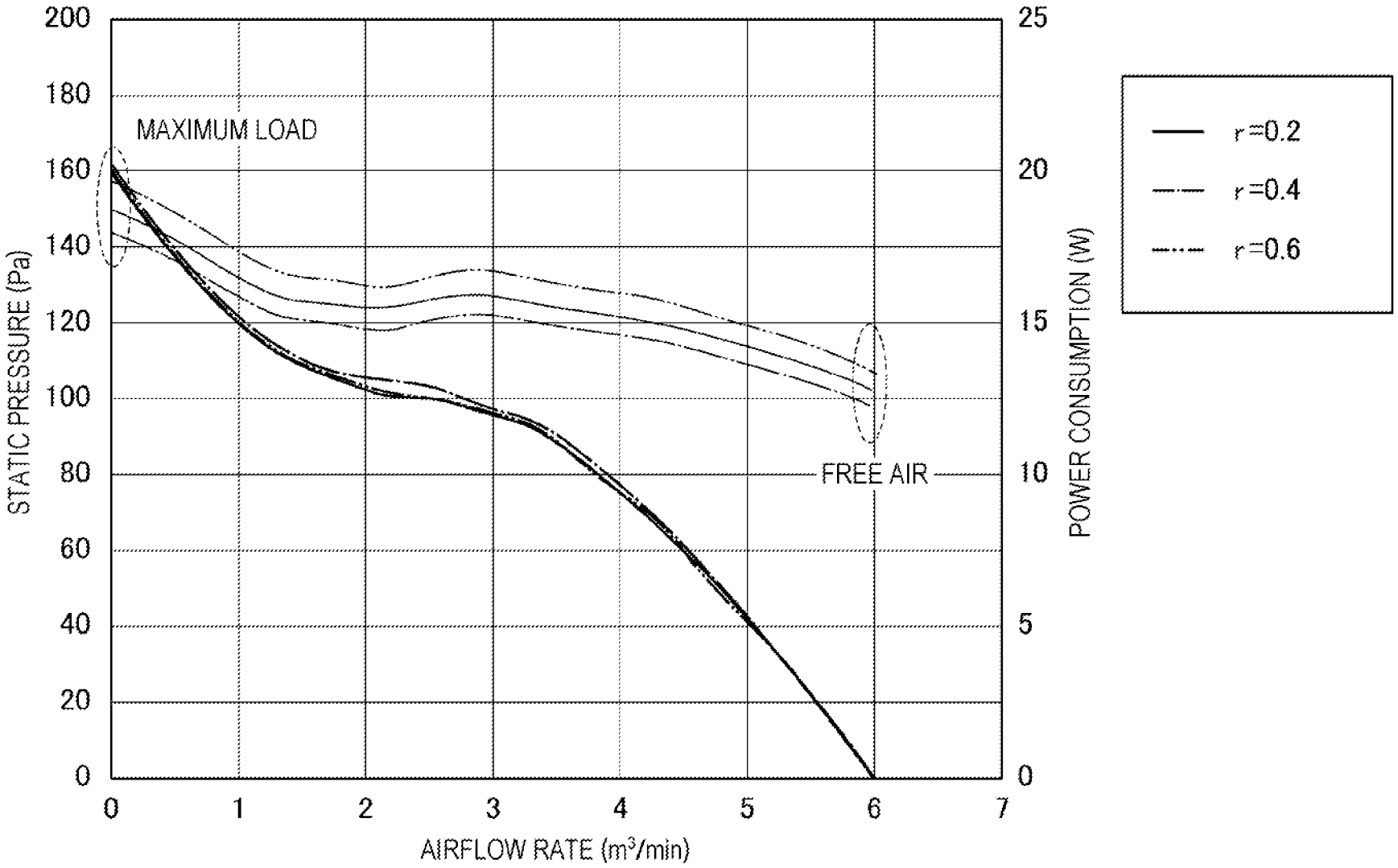
FIG. 10 is a graph illustrating measurement results of power consumption, which correspond to a position at the vertex of a convex curve as a starting position of a curved portion, of a plurality of impellers having the same PQ characteristics.

In FIG. 10, r was set at 0.2, 0.4, or 0.6. Moreover, each of the axial fans was turned on with an appropriate amount of electric power in such a manner that the impeller demonstrated the same PQ characteristics at any value of r. FIG. 10 is a graph illustrating measurement results of power consumption obtained under such a condition. Specifically, the axial fan including the impeller where r=0.2 was turned on with a predetermined amount of electric power first. The PQ characteristics of and power consumed at the time of a change in airflow rate of the axial fan were then measured. Next, the axial fan including the impeller where r=0.4 was turned on with an amount of electric power that demonstrates a static pressure (for example, 120 MPa) at the time of output of a specific airflow rate (for example, 1 $m^3$/min) demonstrated by the axial fan including the impeller where r=0.2. The power consumption at this point in time was measured.

In this manner, the power consumption of when a static pressure similar to that of the axial fan including the impeller where r=0.2 was obtained was measured in a range of an airflow rate from 0 to 6 $m^3$/min. Similarly, the power consumption of the axial fan including the impeller where r=0.6 was measured.

FIG. 10 illustrates that the similar PQ characteristics can be obtained with a less amount of electric power than the other axial fans, from the axial fan including the impeller where r=0.4. In other words, FIG. 10 illustrates that the power efficiency of the axial fan including the impeller where r=0.4 is more excellent than the axial fan including the impeller where r=0.2 or 0.6.

Figure 11:
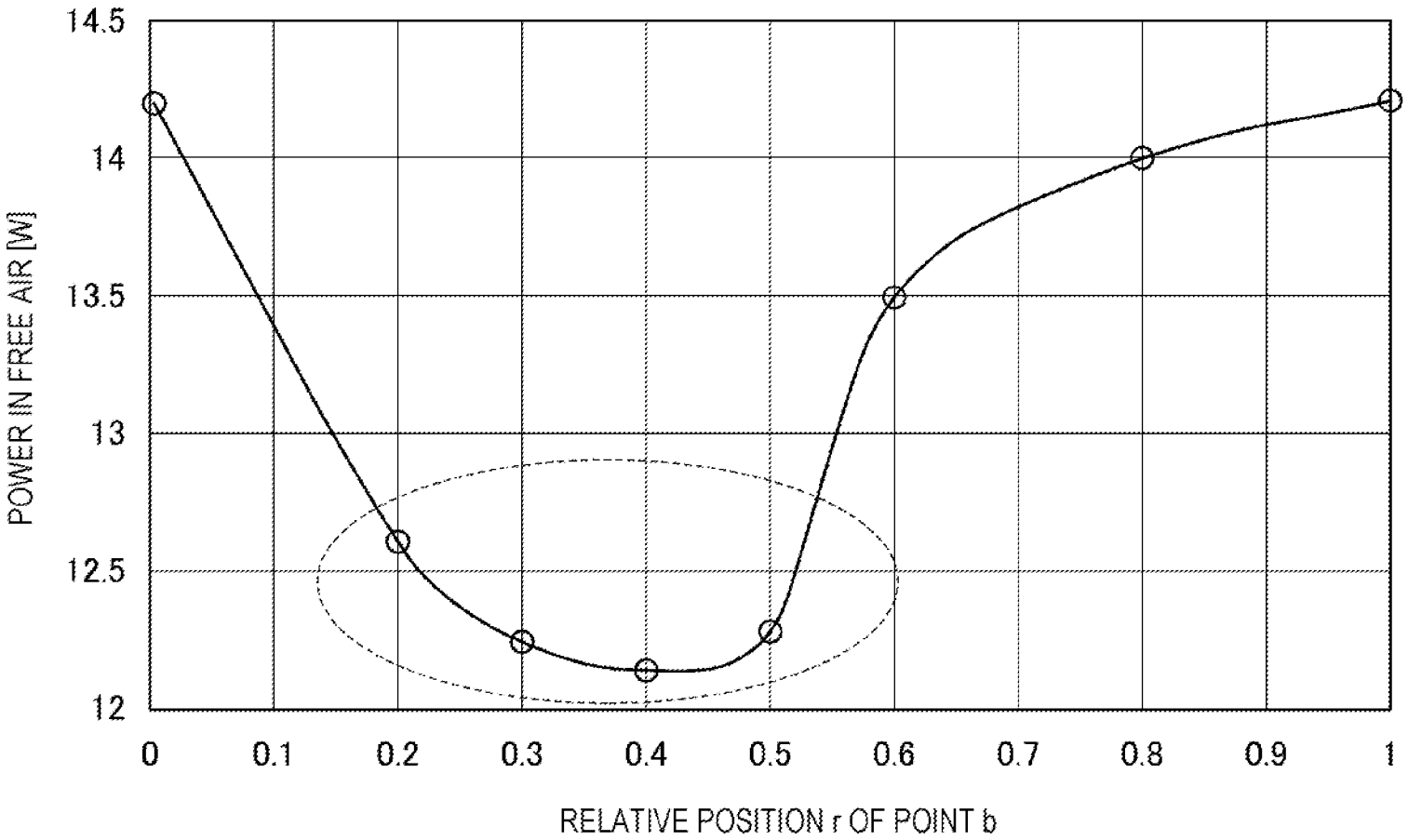
FIG. 11 is a graph illustrating measurement results of power consumption in free air corresponding to the position at the vertex of the convex curve as the starting position of the curved position.

Furthermore, it was studied which range r should be in to realize an efficient axial fan. Prior to such a study, a relationship between the PQ characteristics and power consumption of the axial fan including point b at a different position on the blade 2 was confirmed from FIG. 10. In FIG. 10, the static pressure-airflow rate curves of the corresponding axial fans are aligned within the measurement airflow rate range (0 to 6 $m^3$/min), maintaining substantially the same spacing, at any value of 0.2, 0.4 or 0.6 of r. Therefore, when the axial fans each having a different r were operated on a condition demonstrating the same PQ characteristics, it was confirmed that power consumption changes similarly depending on the change of the airflow rate in these axial fans. Hence, the power consumption with which the PQ characteristics in free air (at no load) were demonstrated was selected as a representative from various PQ characteristics. An optimum value of r of the axial fan demonstrating the representative PQ characteristics was then studied. FIG. 11 illustrates measurement results of power consumption in free air, the results being obtained by changing r in various manners. As illustrated in FIG. 11, when r was set in such a manner as to satisfy a relationship of $0<r\leq0.6$, power in free air was reduced. Especially when r was set in such a manner as to satisfy a relationship of $0.2\leq r\leq0.6$, it was confirmed that the power in free air was further reduced, and was equal to or less than 12.7 W.

Note that in FIG. 11, the optimum range of r was discussed based on the power consumption measured in free air. Such an optimum range of r can also be similarly obtained on another operating condition. This is because it has been confirmed in FIG. 10 that even when the operating condition changes, power also changes accordingly as in the case of the original condition. Therefore, it was confirmed in FIG. 11 that r satisfies the relationship of preferably $0<r\leq0.6$, more preferably $0.2\leq r\leq0.6$ on any operating condition.

Up to this point the embodiment of the present disclosure has been described. However, it is needless to say that the technical scope of the present disclosure should not be construed in a limited manner by the above detailed description. The above-mentioned embodiment is a mere example. Those skilled in the art understand that the above-mentioned embodiment can be modified in various manners within the scope of the disclosure described in the claims. The technical scope of the embodiment should be determined based on the scope of the disclosure described in the claims and the scope of equivalents thereof.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An axial fan comprising a plurality of blades configured to produce an air current flowing from an inlet side to an outlet side, wherein each blade includes a curved portion rising toward the inlet side along an outer peripheral edge of each blade, a starting position of the curved portion delineates a convex curve protruding radially outward on each blade as viewed from the inlet side, and letting a total length of the convex curve be X, a length Y from an end of the convex curve on a front edge of each blade to a vertex of the convex curve satisfies a relationship of $0<Y\leq0.6X$ as viewed from the inlet side.

2. The axial fan according to claim 1, wherein the length Y satisfies a relationship of $0.2X\leq Y$.

3. The axial fan according to claim 1, wherein the end of the convex curve on the front edge of each blade is located radially inward of an end of the convex curve on a back edge of each blade.

* * * * *